US005482401A

United States Patent [19]

Spisak

[11] Patent Number: 5,482,401

[45] Date of Patent: Jan. 9, 1996

[54] BOAT-LIFT APPARATUS

[76] Inventor: Joseph Spisak, 231 Poplar Hill Rd., Binghamton, N.Y. 13901

[21] Appl. No.: 161,364

[22] Filed: Dec. 6, 1993

[51] Int. Cl.[6] ..... B63C 3/06

[52] U.S. Cl. ..... 405/3; 114/44; 405/221; 254/10 C

[58] Field of Search ..... 405/3, 221; 254/10 C; 114/44–48; 414/678

[56] References Cited

U.S. PATENT DOCUMENTS

| | | | |
|---|---|---|---|
| 907,645 | 12/1908 | Sauber | 405/221 |
| 3,614,871 | 10/1971 | Nordell | 405/221 |
| 5,046,897 | 9/1991 | Ray | 405/221 |

*Primary Examiner*—Dennis L. Taylor
*Attorney, Agent, or Firm*—Salzman & Levy

[57] ABSTRACT

The present invention features an adjustable corner assembly for a boat-lift. The corner assembly of this invention may be designed to replace corner posts of other boat-lift mechanisms. It can also be designed as part of a boat-lift frame. In either capacity, it is very flexible in its adjustment, so that the lifting frame may be raised from the water without the need for adjusting and/or securing the posts below the water level. In one embodiment, the corner assembly has a footing that is placed to rest on the bottom of a body of water. One leg extends upwardly from the footing. A small plate is welded to otherwise secured inside the leg. The plate has a threaded hole in the center for receiving and rotatively securing a worm drive. The worm drive is rotatably placed through a cap affixed atop a sleeve. The sleeve slides upon the leg, as the worm drive is rotated. The worm drive extends above the cap of the sleeve, where it is rotatively, manually cranked by wrench or other suitable tool, or by an electric motor.

8 Claims, 4 Drawing Sheets

BOAT-LIFT APPARATUS

FIELD OF THE INVENTION

The present invention pertains to a boat-lift apparatus and, more particularly, to a mechanism for lifting watercraft out of the water so that adjustments can be made to the lift mechanism from above the water.

BACKGROUND OF THE INVENTION

Known within the art of water recreation are mechanisms for lifting boats out of the water for such purposes as making repairs or dry-docking. One such mechanism is shown in U.S. Pat. No. 5,184,914 (issued to S. Basta on Feb. 9, 1993), entitled LIFT FOR WATERCRAFT. The subject patent illustrates a frame that cradles the boat, lifting it from the water by means of a hydraulic ram. The frame contains four corner posts, or stanchions, for supporting the boat-and-frame combination. These corner posts have footings, or shoes, that rest on the bottom of the water. Sleeves attached to the frame slide on the corner posts. Once in position, these sleeves require that pins be placed through indexing holes in the corner posts, in order to secure the frame in the lifted position. This requires personnel to enter the water in order to place the pins into the holes. This is not only inconvenient, but is also inefficient, uncomfortable and potentially dangerous.

The frame corners are often unbalanced. What frequently occurs is that at least one post can be secured easily by a pin, while another post cannot. This, then, requires shims to be placed under the footings of the unsecured posts. The height of any given post may have to be adjusted, so that the pin will slip through one of the index holes in the sleeve adjacent a post hole. Such a procedure is fraught with danger and difficulty, owing to the facts that all of the above must be completed underwater and the boat-and-frame combination bears a tremendous weight upon the footing.

Another disadvantage of the aforementioned mechanism is the requirement of a hydraulic lift mechanism. To pump the hydraulic fluid therefor requires electrical power, which is certainly not always available at remote locations. A further disadvantage of such a device is the relative cost of having to supply a complex powered mechanism in order to lift a boat from the water.

The present invention seeks to provide a replacement corner post for devices such as the aforesaid boat-lift, so that difficult adjustments are eliminated.

Furthermore, one of the objectives of the present invention is to provide a corner post mechanism that can be adjusted above the water level, by means of an internal, mechanical worm drive. The worm drive of the inventive corner post can be manually cranked, or, if electricity is available, a small electrical motor can be used. The adjustments are made to each corner independently, one at a time, as needed. This eliminates the necessity for personnel to enter the water in order to adjust the post height.

DISCUSSION OF RELATED ART

In U.S. Pat. No. 2,687,617 (issued to F. S. Newell on Aug. 31, 1954), entitled DEMOUNTABLE PIER STRUCTURE, adjustable footings are shown which are adjusted by means of internal angle bolts that are threaded into threaded end plugs. The angle bolts and end plugs are used on a pier frame to level same. However, the footings are designed for a single adjustment (further adjustment is rarely needed); therefore, the threaded mechanism is in the form of angle bolts and end plugs, which are turned by a wrench applied to a hex-nut.

In contrast, the present invention uses a smoothly turning worm mechanism that is hand- or motor-cranked. Using a worm drive for this purpose is quite practical, since this mechanism can enable the height of the corner supports to be adjusted innumerable times. Furthermore, a worm mechanism is highly effective in lifting a temporary frame. The mechanisms can be interchangeable, so that they can fit on any corner. The pier corner posts of the prior art are, by contrast, designed to be adjusted for a permanent setting place. Once adjusted, they must be placed back in the same corners as before.

SUMMARY OF THE INVENTION

In accordance with the present invention, there is provided an adjustable corner assembly for a boat-lift. The corner assembly of this invention may be designed to replace corner posts of other boat-lift mechanisms. It can also be designed as part of a boat-lift frame. In either capacity, it is very flexible in its adjustment, so that the lifting frame may be raised from the water without the need for adjusting and/or securing the posts below the water level. In one embodiment, the corner assembly comprises a footing that is placed to rest on the bottom of a body of water. One leg thereof extends upwardly from the footing. A small plate is welded to or otherwise secured inside the leg. The plate has a threaded hole in the center thereof for receiving and rotatively securing a worm drive. The worm drive is rotatably disposed through a cap affixed atop a sleeve. The sleeve slides upon the leg, as the worm drive is rotated. The worm drive extends above the cap of the sleeve, where it is rotatively cranked by hand or by an electric motor.

BRIEF DESCRIPTION OF THE DRAWINGS

A complete understanding of the present invention may be obtained by reference to the accompanying drawings, when considered in conjunction with the subsequent detailed description in which.

DESCRIPTION OF THE PREFERRED EMBODIMENT

Generally speaking, the invention features a leveling device that allows for easy adjustment and securement of the end corners of a boat-lift frame. The end corners of the invention are interchangeable with existing boat-lift frame end corners. They may also be designed in combination with a simple frame, requiring no hydraulic lifting mechanisms. The corner assemblies of the invention can be adjusted and secured from above the water level, thus eliminating the inconvenient and inefficient need for workers to enter the water.

Figure 1:
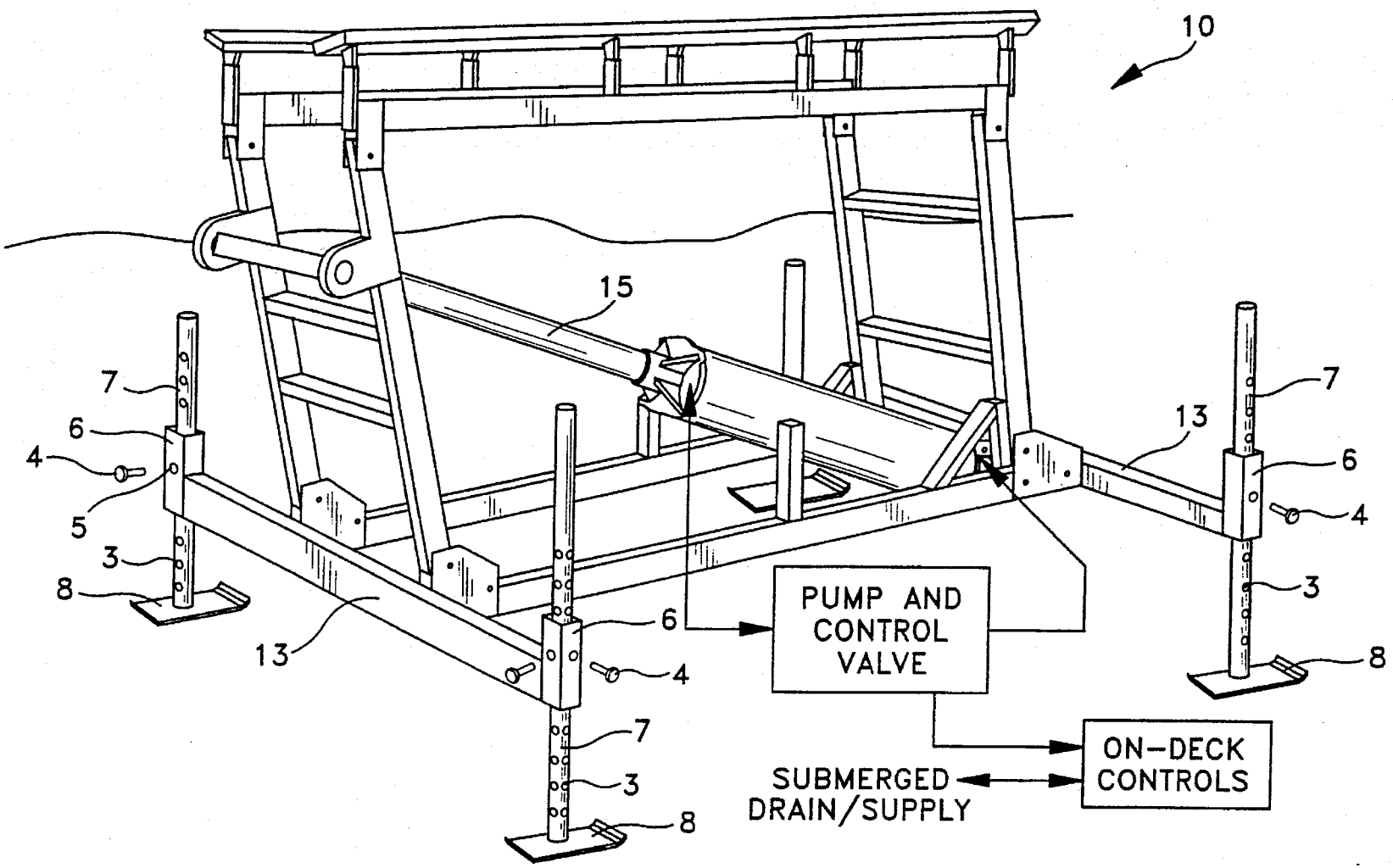
FIG-1 PRIOR ART
FIG. 1 illustrates a perspective view of a typical boat-lift mechanism of the prior art.

Now referring to FIG. 1, a hydraulic, boat-lift frame 10 of the prior art is shown. The boat-lift frame 10 includes cross-members 13 and comprises four end corner posts 7 that have footings 8 and slidable sleeves 6. The frame 10 is lifted by means of a hydraulically actuated ram 15. Each sleeve 6 has corner holes 5 for receiving indexing pins 4 that are placed into the holes 5 in order to align with one of a plurality of index holes 3 disposed in the post 7. This is done in order to secure the height position of the sleeve 6 with respect to the post 7, once the frame 10 has been lifted by ram 15.

Oftentimes, one corner post 7 may be unbalanced with respect to the other posts, or one of the indexing holes 3 may not align with its respective sleeve hole 5. Such conditions require that shims be placed below footings 8. This necessitates personnel entering the water to make the necessary adjustments. The placement of the pins 4 into aligning holes 3 and 5, respectively, also requires workers to enter the water.

Figure 2:
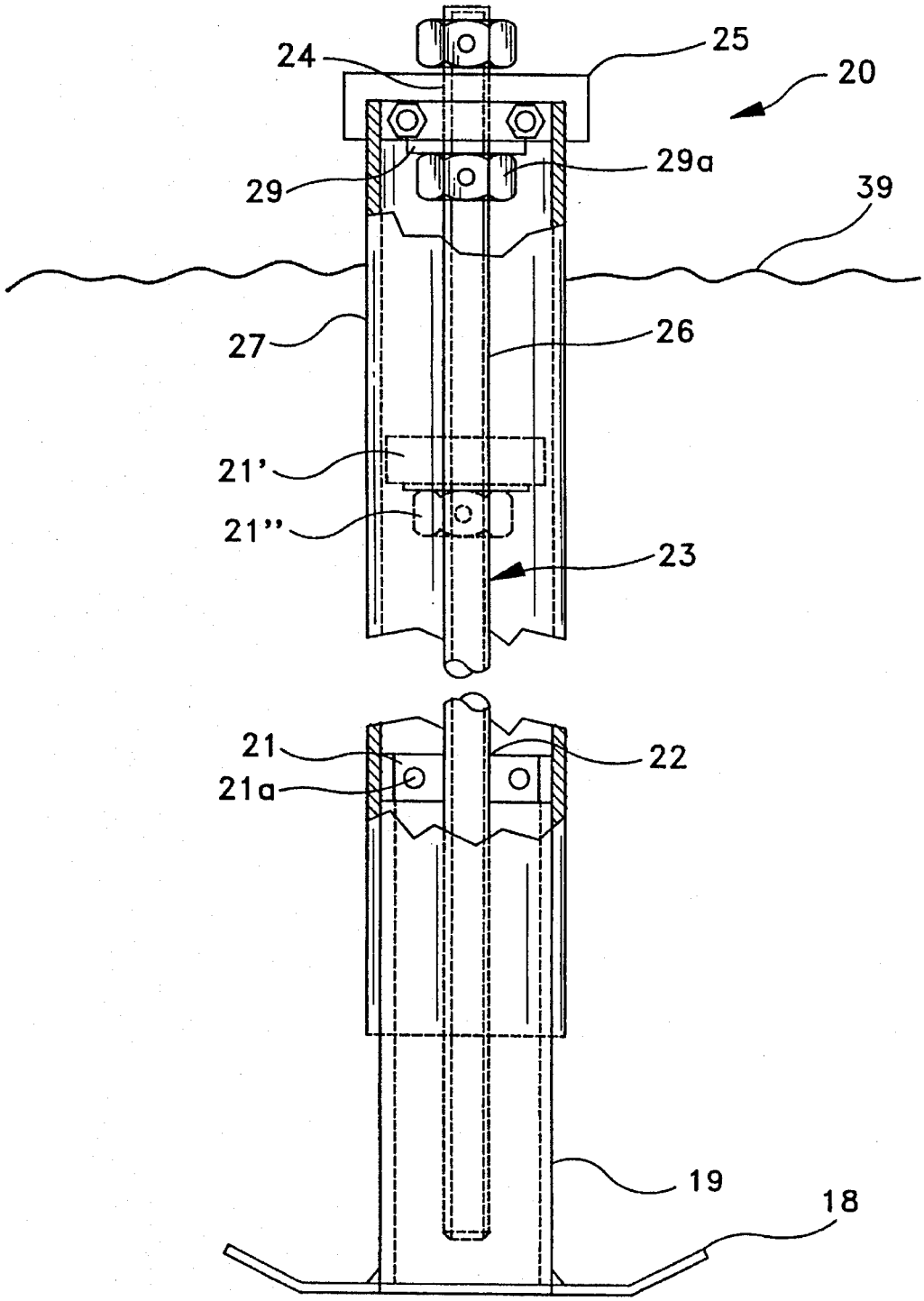
FIG. 2 shows a sectional view of the adjustable corner post assembly of this invention.

Referring to FIG. 2, the corner post 20 of the present invention is illustrated in cross-sectional view. The corner post 20 comprises the foot 18 to which is welded an upright, hollow extension leg, or post, 19. A hollow, slidable sleeve or housing 27 is disposed over the hollow leg 19 and slides relative thereto. Secured by suitable bolts or pins 21*a* to the inside of the leg 19 is a tapped plate 21 having a threaded hole 22 for receiving a rotatable worm 23, which extends into the hollow leg 19, as shown. An additional shaft support plate 21' is unthreaded and disposed between the plate 21 and the uppermost portion of the sleeve 27 to provide additional support for the worm 23. Shaft support plate 21' is itself supported by a pinned bolt 21".

The worm 23 extends upwardly and is rotatively secured in a smooth hole 24 of a cap 25 by means of a washer 29 and pinned bolt 29*a*. Cap 25 is secured by bolts 25*a* to the top of sleeve 27. The sleeve 27 slides upon leg 19 through the force of the rotation of worm 23. The worm 23 does not require threading either above the cap 25 or along a shaft portion 26, disposed inside sleeve 27. The worm 23 is designed to accommodate a handle or crank member (not shown). The crank member may be either manual (having a dog-leg shape or comprising a ratchet wrench and socket) or one that is electrically driven by a small motor (not shown).

The corner post assembly 20 of the invention is caused to lengthen or shorten by the turning of the worm 23 in either a clockwise or counterclockwise direction, depending upon the direction of the thread. The rotation of the worm 23 causes the sleeve 27 to slide over the inner leg member 19, as aforementioned.

The corner post 20 is designed to extend above the water level 39, so that the sleeve 27 can be extended upwardly without it having to go into the water. The thread of worm 23 allows for any desired position along the worm shaft, thus eliminating the drawback associated with the prior art, i.e., the index hole securement. In addition, there is no need or requirement for pinning the posts 20, since the worm 23 holds the sleeve 27 in the desired, adjusted position.

Figure 3:
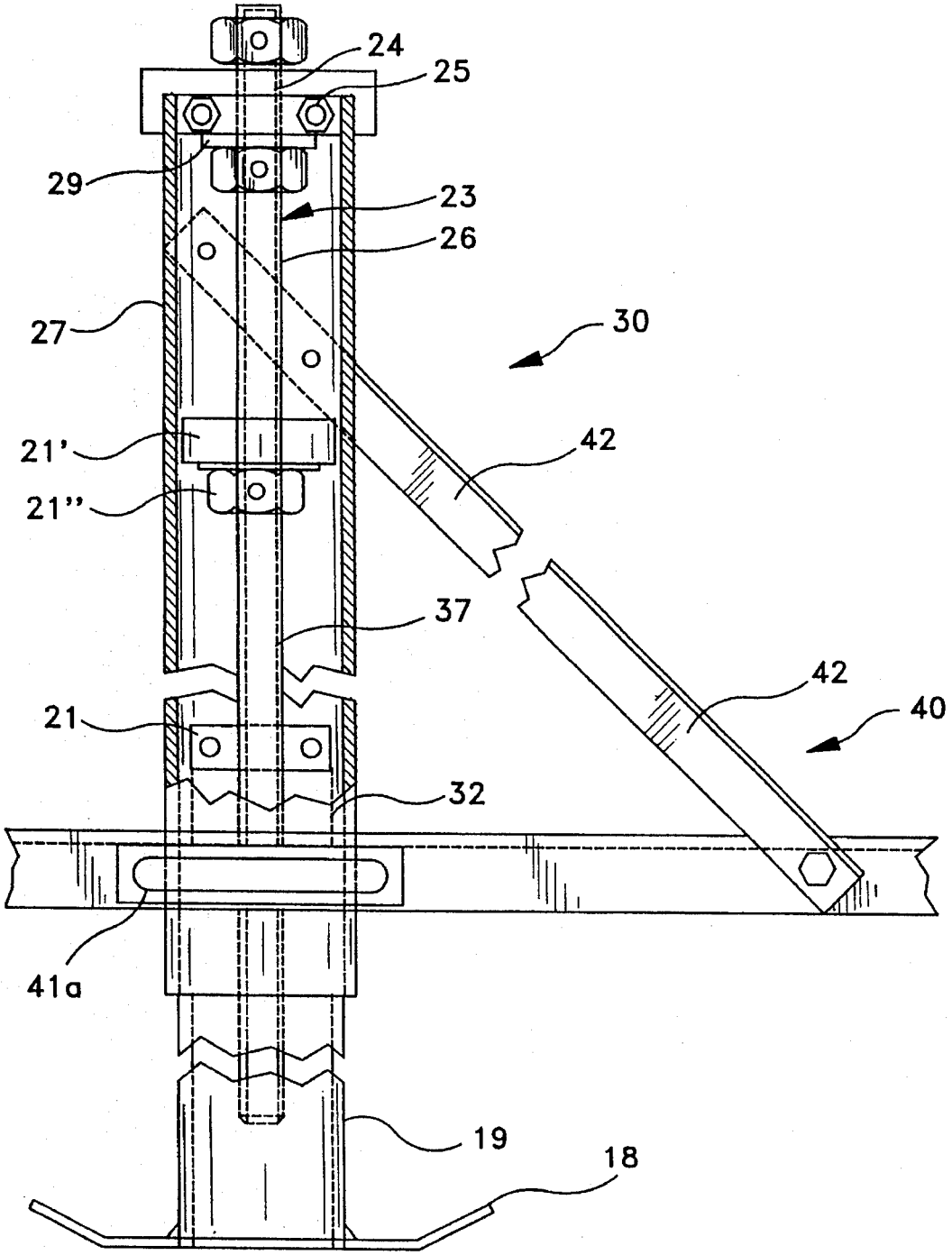
FIG. 3 depicts a partial, cut-away view of an alternate embodiment of the corner post assembly illustrated in FIG. 2, as well as the corner post mechanism in combination with a cantilever boat-lift frame.
Figure 4:
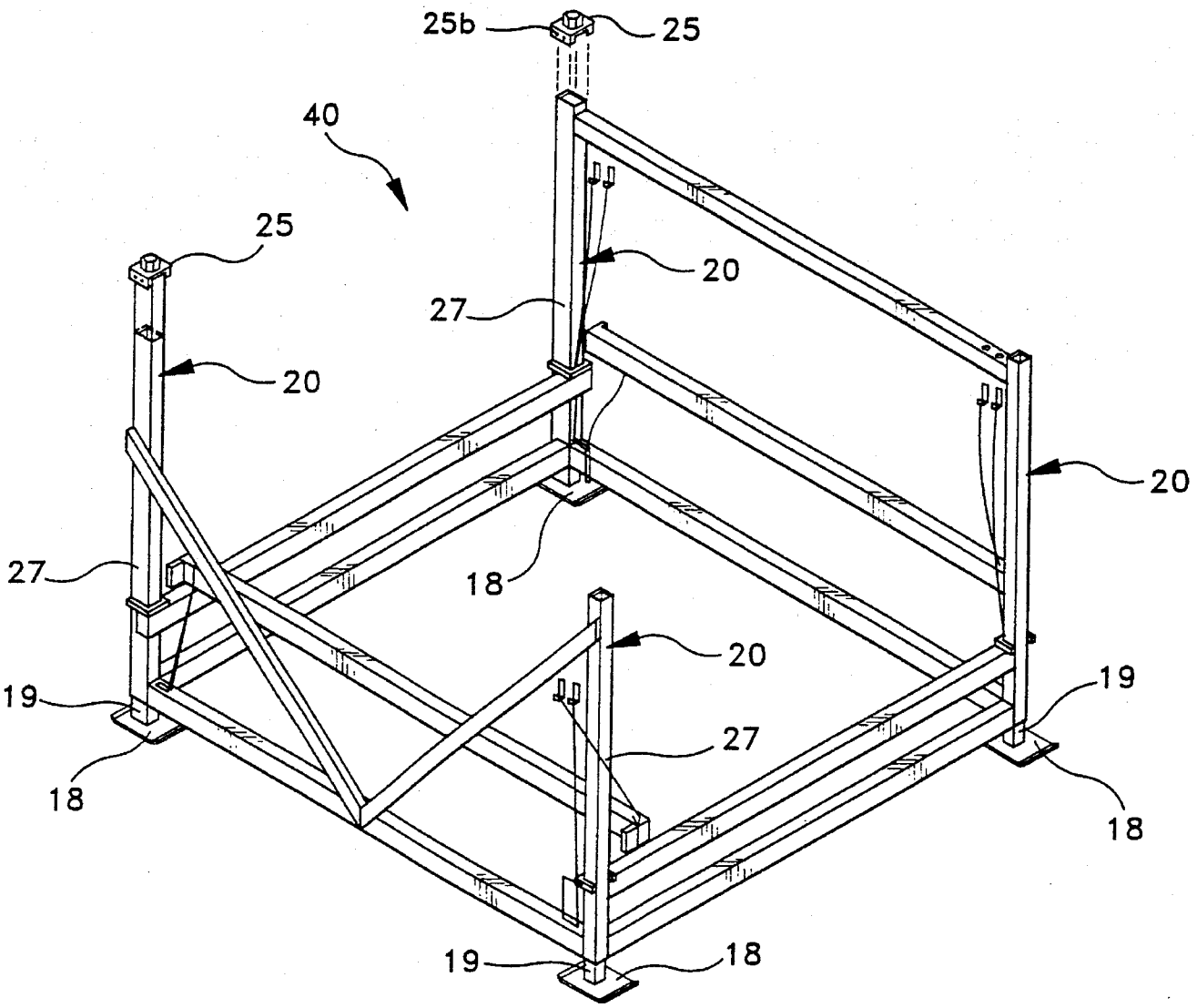
FIG. 4 illustrates a perspective view of four independently adjustable corner post assemblies and respective caps, used with a boat lift.

The post 20 can be a replacement member for the corner posts 7 of FIG. 1, or it may be designed as part of a boat-lift assembly, illustrated in FIGS. 3 and 4.

Referring to FIG. 3, there is shown the leveling device of the present invention for use with a cantilever boat-lift. Certain modifications to the structure are made to accommodate the cantilever function as opposed to the conventional vertical lift.

The upper portion 26 of the worm 23 is depicted as before; it is secured for rotation in the smooth bore hole 24 disposed in the cap 25 of sleeve 27 by washer 29. Again, the rotation of the worm 23 in either a clockwise or counterclockwise direction, respectively, causes the sleeve 27 to slide up or down with respect to the post 19.

It should also be noted that a frame 41 of a cantilever lift 40 is shown bolted to the sleeve member 27 by means of a U-bolt 41*a*. Such a frame 40, in combination with the adjustable corner post assembly 20 or 30, can also be braced by angle members 42, as illustrated. Moreover, the foot 18 has greater overall dimensions for cantilever lift use due to the fact that the lift is supported only on the bottom frame.

Referring to FIG. 4, a complete frame 40 is shown, in combination with the corner post assemblies 20 or 30. The corner posts 20 are rectangularly shaped in cross-section, but it is to be understood that they may also be round, hexagonal, etc. The frame 40 is designed to be integral with the four corner post sleeves 27, so that, about each corner, the frame can be independently adjusted in height. Also shown in FIG. 4 are individual caps 25, having predrilled holes 25*b*, so that bolts 25*a* (FIG. 2) may be inserted therein to secure each respective cap 25 to its sleeve 27.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An adjustable corner assembly for a boat-lift, comprising:

a footing that is placeable upon the bottom of a body of water, and provides support for said adjustable corner assembly;

a leg member extending upwardly from said footing;

a frame supported by said leg member;

a hollow sleeve slidably disposed upon said leg member, said hollow sleeve providing a telescoping of said leg member in order to provide improved lateral support;

a rotatable worm member disposed inside said hollow sleeve and extending from said hollow sleeve above a level of said body of water, said worm member being rotatably movable within said hollow sleeve;

a first worm securement member comprising a washer secured to an upper portion of said hollow sleeve for supporting said rotatable worm member for rotation therein;

a second worm securement member comprising a plate having a threaded hole for receiving said rotatable worm member, said second worm securement member secured to said leg member for supporting said worm member for rotation with respect to said leg member, said rotatable worm member rotatably causing said hollow sleeve to move into relative slidable engagement with respect to said leg member, whereby said corner assembly is caused to change height; and a worm support plate disposed between said first and second worm securement members.

2. The adjustable corner assembly for a boat-lift, in accordance with claim 1, wherein said plate supports a hollow shaft, said hollow shaft supporting a lead screw nut having a threaded hole for receiving said rotatable worm member and accommodating rotation of said rotatable worm member with respect to said leg member.

3. A cantilever boat-lift assembly comprising:

a) at least one adjustable pressure-bearing assembly comprising:

i) a footing that is placeable upon the bottom of a body of water, and provides support for said adjustable corner assembly;

ii) a leg member extending upwardly from said footing;

iii) a hollow sleeve slidably disposed upon said leg member, and providing a telescoping adjustment of a height of support of said adjustable corner assembly, with improved lateral support therefor;

iv) a rotatable worm member disposed inside said hollow sleeve and extending from said hollow sleeve above a level of said body of water, said worm member being rotatably movable within said hollow sleeve;

v) a first worm securement member secured to said hollow sleeve for supporting said rotatable worm member for rotation therein; and vi) a second worm securement member secured to said leg member for supporting said worm member for rotation with respect to said leg member, said worm securement member comprising a plate secured to said leg member, said plate supporting a hollow shaft, said hollow shaft supporting a lead screw nut having a threaded hole for receiving said rotatable worm member and accommodating rotation of said rotatable worm member with respect to said leg member, whereby, when said worm is rotated, said hollow sleeve will be caused to move into relative slidable engagement with respect to said leg member, whereby said corner assembly will be caused to change height;

b) a cantilever lift frame;

c) a brace attached to said cantilever lift frame, said brace being mounted to said hollow sleeve; and d) a U-bolt assembly for attaching said cantilever lift frame to said hollow sleeve.

4. The cantilever boat-assembly in accordance with claim 3, wherein said first worm securement member comprises a washer disposed at an upper portion of said hollow sleeve.

5. An adjustable corner assembly for a boat-lift, comprising:

a footing that is placeable upon the bottom of a body of water, and provides support for said adjustable corner assembly;

a leg member extending upwardly from said footing;

a hollow sleeve slidably disposed upon said leg member and providing a telescoping adjustment of a height of support of said adjustable corner assembly, with improved lateral support therefor;

a rotatable worm member disposed inside said hollow sleeve and extending from said hollow sleeve above a level of said body of water, said worm member being rotatably movable within said hollow sleeve;

a first worm securement member comprising a first washer disposed within said hollow sleeve for supporting said rotatable worm member for rotation therein, and a predrilled pressure cap fastened to the uppermost portion of said hollow sleeve; and a second worm securement member comprising a plate secured to said leg member and having a threaded hole for supporting said worm member for rotation with respect to said leg member, said rotatable worm member rotatably causing said hollow sleeve to move into relative slidable engagement with respect to said leg member, whereby said corner assembly is caused to change height.

6. The adjustable corner assembly for a boat-lift in accordance with claim 5, further comprising a worm support plate disposed between said first and second worm securement members.

7. The adjustable corner assembly for a boat-lift in accordance with claim 6, wherein said worm support plate further comprises a second washer disposed within said hollow sleeve for supporting said rotatable worm member.

8. The adjustable corner assembly for a boat-lift in accordance with claim 7, further comprising a pair of means for supporting said first and second washers, respectively, and for securing said first worm securement member and said worm support plate, respectively.

* * * * *